United States Patent [19]

Labbe et al.

[11] 4,390,032

[45] Jun. 28, 1983

[54] CIGARETTE VENTILATION CONTROL

[75] Inventors: Francis A. M. Labbe, Neuilly-sur-Seine, France; Edward G. Preston, London, England

[73] Assignee: Molins Limited, London, England

[21] Appl. No.: 210,814

[22] Filed: Nov. 26, 1980

[30] Foreign Application Priority Data

Nov. 29, 1979 [GB] United Kingdom ..... 7941158

[51] Int. Cl.[3] ..... A24C 5/60

[52] U.S. Cl. ..... 131/281

[58] Field of Search ..... 131/281

[56] References Cited

U.S. PATENT DOCUMENTS 4,121,595 10/1978 Heitmann ..... 131/281

*Primary Examiner*—V. Millin

*Attorney, Agent, or Firm*—Antonelli, Terry & Wands

[57] ABSTRACT

An apparatus and a method for making ventilated cigarettes. Either the cigarettes are perforated after assembly or the tipping paper is perforated before assembly. The position of the perforations as a group relative to the mouth end of the cigarette is adjustable to select a required degree of ventilation of the assembled cigarette. Automatic selection is effected by measuring the dilution of the assembled cigarettes and causing the perforator to be controlled accordingly. Perforation may be effected by pins mechanically, by spark discharge by laser or by electron beam.

27 Claims, 5 Drawing Figures

CIGARETTE VENTILATION CONTROL

This invention relates to the manufacture of ventilated cigarettes, that is to say, cigarettes which are provided with means for admitting air through the wrapper to dilute the smoke inhaled by the smoker.

One method of admitting air which is commonly used, is to provide perforations in the filter tip of the cigarette. This can be done either by using pre-perforated tipping paper to attach the tip to the cigarette rod, with suitably porous "plug-wrap" enclosing the filter tip, or by perforating the whole cigarette after assembly, for example with steel pins. It is difficult to provide fine adjustment of the amount of dilution in such systems, since this can normally only be achieved by varying the number of pins which engage the cigarette, or tipping paper, so as to change the number of perforation holes, or by changing the size of the holes, e.g. by using different size perforating pins. Any of these methods are liable to be mechanically clumsy, and in any case they can only produce relatively large "step" changes in dilution.

According to the present invention there is provided a device for perforating cigarettes, cigarette paper, or cigarette tipping paper, including means for adjusting the mean position of the group of resultant perforations, relative to the end of the cigarette or the edge of the tipping paper, as the case may be. The device can take any of a variety of forms, for example, it may be a mechanical device having perforating pins, or it may be electrical—for example using electrodes supplied with high voltage to perforate the paper with sparks—or it may utilise radiated energy for example in the form of a laser or electron beam. The adjustment may be achieved by repositioning a part of the perforating device itself, or by shifting the path of the paper or cigarettes passing through it.

In the case of a mechanical perforator in particular, the invention has the advantage that very fine adjustment of the degree of dilution can be achieved, making it possible to provide a system in which a wide range of dilution can be catered for by altering the number of pins engaging the cigarette (or paper), while small variations within the range are provided by altering the relative positions of the pins and the cigarettes (or paper).

According to a further feature of the invention there is provided apparatus for manufacturing ventilated cigarettes, including a perforator for cigarettes, cigarette paper, or tipping paper, means for measuring the resultant dilution of the finished cigarettes, and means for controlling the position of the resultant perforations, relative to the mouth ends of the finished cigarettes, for example by altering the relative positions of the perforator device and the cigarettes, cigarette paper, or tipping paper which is being perforated, so as to achieve the desired level of dilution. The dilution may be measured for example using the cigarette testing device described in our U.S. patent application Ser. No. 145,231, now U.S. Pat. No. 4,325,250, while perforation may be achieved using perforating apparatus similar to that described in our British application Nos. 13690/78 (published under the number 2,018,568A), or 7,927,004, for example.

The invention will now be described by way of example with reference to the accompanying drawings in which.

Figure 1:
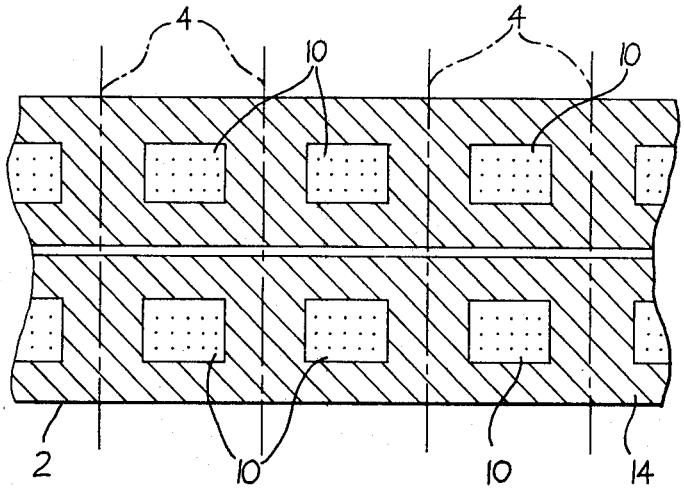
FIG. 1 shows a web of "cork" or tipping paper made by the method of the invention.
Figure 2:
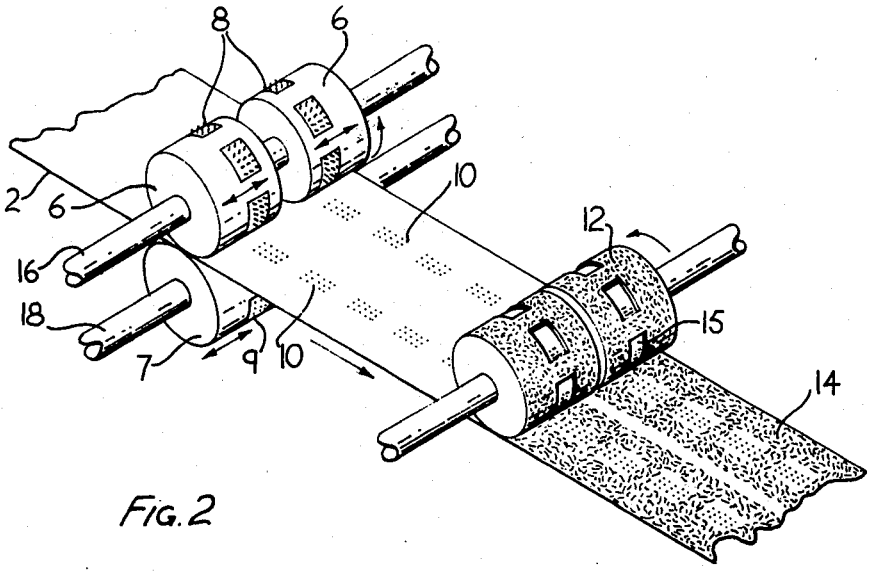
FIG. 2 shows diagrammatically, one form of apparatus for producing the tipping paper of FIG. 1.

FIG. 1 shows a web 2 of tipping paper which is twice the width required for assembling one cigarette, so that "double-length" cigarettes can be assembled from it in a known fashion. The positions at which cuts will be made to separate the individual portions of the web are indicated by the broken lines 4. As the web is fed into a "plug-assembler" device, it first passes under a pair of rollers 6, FIG. 2, which have groups of perforating pins 8 arranged so as to form patches 10 of perforations in the paper.

A pair of backing rollers 7, of the same diameter as roller 6, are arranged beneath the path of the web, and formed with areas of indentations 9 corresponding to the pins 8. In order to facilitate the formation of these indentations, the surface of the roller 7 is preferably made of a thermoplastic material, while the pins are steel. The indentations can then be formed initially by heating the rollers 7 and running the two pairs of rollers 6 and 7 together. In use rollers 6 and 7 are geared together so that their rotation is synchronised.

Each patch of perforations provides an area of ventilation for an individual cigarette assembly, the rollers 6 and 7 being geared to a cutting device downstream (not shown) so that the perforations are formed in the right places. A further roller 12 applies adhesive 14 to the web before it is cut off leaving "windows" 15 around the perforated areas, the roller 12 also being suitably geared to the cutting device.

In the meantime the lengths of cigarette rod and filter tips are also being fed by suitable feeding means, not shown, to an assembly device to be assembled using the cut-off portions of tipping paper.

In order to provide the possibility of adjusting the ventilation level of the finished cigarettes by varying the axial position of the perforation holes in the filter tips, the pairs of rollers 6 and 7 are also made axially adjustable on their respective shafts 16 and 18. For example they may be made to slide on keyways on the shafts. The adjustment is such that, considering that the mouth ends of the finished cigarettes will be at the center of the double-width tipping paper, each pair of rollers will be moved apart to decrease the level of ventilation by shifting the perforation holes further from the mouth end of the cigarette, and will be moved together to increase the ventilation by shifting the holes closer to the mouth ends of the cigarettes. With this arrangement, the windows 15 are arranged to be somewhat wider than the area of pins 10, so that movement of the pins relative to the web will not bring the perforated area outside the window 15. Alternatively roller 12 could comprise two parts arranged to axially separate in synchronism with rollers 6 and 7.

Figure 3:
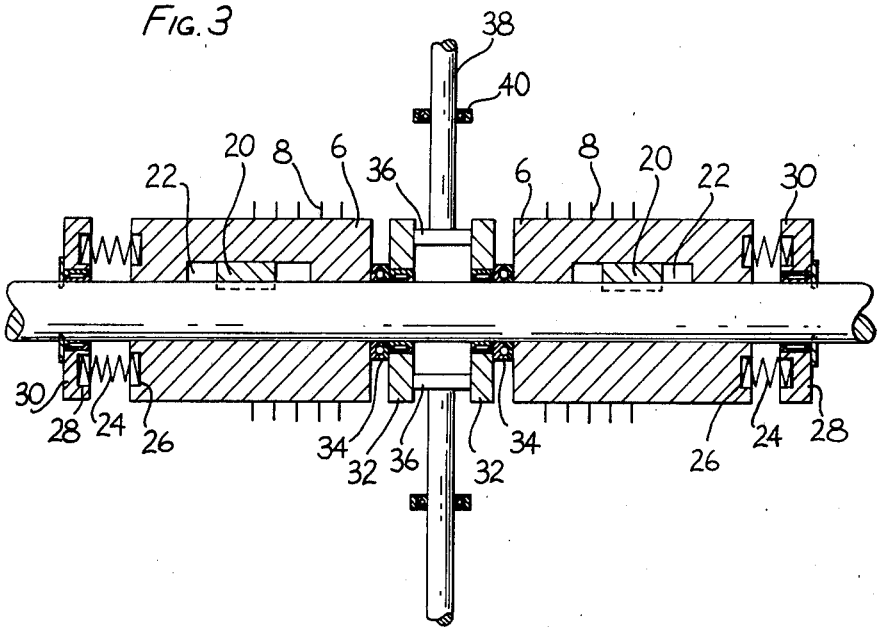
FIG. 3 shows a cross-section and FIG. 3A a part plan view of one form of adjustment device for the apparatus of FIG. 2.
Figure 3A:
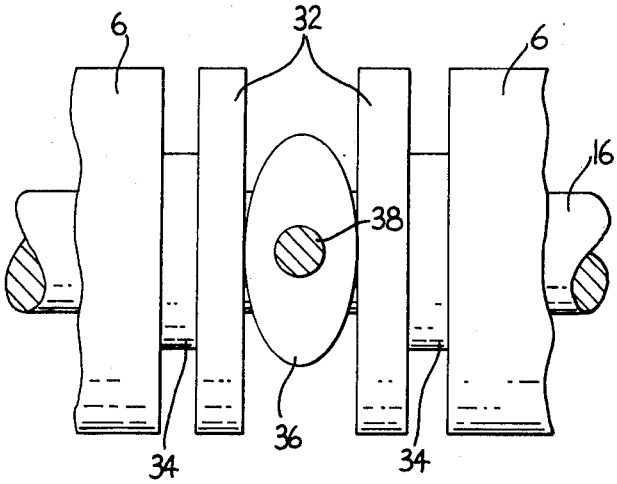

FIG. 3 shows one method of achieving the adjustment of the axial positions of the pairs of rollers, FIG. 3A showing a partial plan view of the device of FIG. 3. Each roller 6 is located on the shaft 16 by means of a key 20 whose axial position on the shaft is fixed. The key engages in a slot 22 in the roller which is longer than the key itself, so as to allow axial movement of the roller. The rollers are biassed inwardly, i.e. towards one another, by springs 24 which are located between recesses 26 in the ends of the rollers and corresponding recesses 28 in the end-stop plates 30. The plates 30 are fixed to the shaft so that they cannot move axially.

At the inner end of each roller 6 a rotatable bearing plate 32 is journalled onto the shaft 16 and a thrust bearing 34 is mounted on the shaft between the plate 32 and the end of the roller 6 so that the shaft can rotate without causing the plates 32 to rotate with it. A pair of elliptical cams 36 are arranged between the pair of plates 32, on mutually opposite sides of the shaft, as shown in the plan view in FIG. 3A. Shafts 38 carrying the cams are journalled in fixed mountings 40, the whole arrangement thus being such that rotation of the cams causes the plates 32 and thus the rollers 6 to move apart or together, shifting the position of the perforations in the web of tipping paper. It will be appreciated that the rollers 7 are mounted in an exactly similar way and are arranged so that their axial movement can be synchronised with that of the rollers 6. The movement of the rollers is preferably controlled by a dilution measuring device which measures the ventilation of the assembled cigarettes and produces a control signal indicating that the dilution should be increased or decreased.

Generally it will be necessary to lift rollers 6 away from the paper surface while any change in their axial positions is effected because otherwise such change could tear the paper. At high machine speeds this would result in at least one section 4 of paper not being perforated. In this case a memory would preferably be employed to record the position of the unperforated section or sections and to reject it or the corresponding assembled cigarette at a later stage.

Instead of the perforations being formed by pins on a roller, they may be formed by rolling the web against a stationary rolling plate having pins on its surface. Alternatively they can be formed by sparking the web in defined areas, or by piercing it with a beam of energy such as a laser or electron beam. In the latter case it will be appreciated that the areas to be perforated can more easily and economically be chosen by deflecting such beams electrically or optically rather than by mechanically moving the perforating source.

Figure 4:
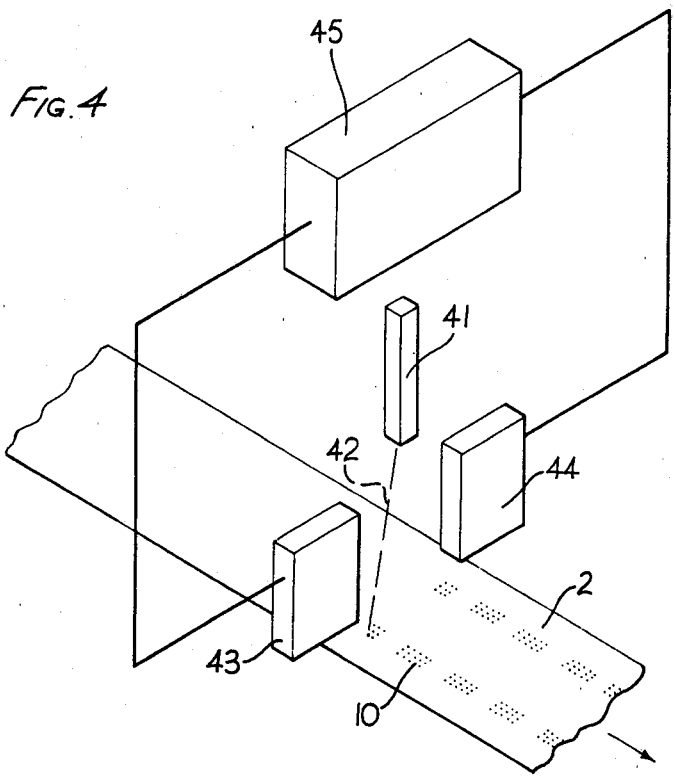
FIG. 4 shows diagrammatically an alternative form of apparatus for producing the tipping paper of FIG. 1.

FIG. 4 illustrates a web 2 of tipping paper being perforated by an electron beam. An electron gun 41 emits a pulsed electron beam 42 which impinges on web 2 to form patches 10 of perforations. The beam 42 is deflected perpendicular to the web 2 by means of electromagnets 43 and 44. Of course different arrangements of magnets may be used to deflect the beam 42 in other directions as required, for example a ring of magnets may surround the beam. An electrostatic deflection system may alternatively be used.

Energisation of electromagnets 43 and 44 in FIG. 4 is effected by control circuit 45 so as to control the separation of the perforation patches 10 from the edges of the tipping paper. Control circuit 45 may be arranged to receive and respond to a feedback signal from a dilution measuring device and could be connected to control the electron gun 41 so as to synchronise the pulsing with the deflection of the beam.

The position and/or the size of the perforations may be deliberately changed temporarily from time to time in order to test the cigarette inspection equipment in accordance with our British Pat. No. 1,541,425. Signals indicating the deliberately fauty cigarettes can then be stored and used to reject those cigarettes if the inspection equipment does not do so, preferably at a different rejection station to that used by the inspection equipment to provide a visual indication of the number of faulty cigarettes missed by the inspection equipment.

We claim:

1. A device for making ventilated cigarettes including means for producing a group of perforations in the wrapper web to form ventilated cigarettes and means for controlling the perforating means to adjust the distance of the resultant group of perforations from the mouth end of the finished cigarettes so as to adjust dilution without altering the number or distribution of the perforations within the group.

2. A device for making ventilated cigarettes including means for perforating the wrapper web to form ventilated cigarettes and means for controlling the perforating means to adjust the position of the resultant perforations relative to the mouth end of the finished cigarettes, wherein said perforating means comprises perforating pins for perforating the cigarette mechanically.

3. A device according to claim 1 for use in the manufacture of filter cigarettes comprising tobacco portions which are joined to filter portions by means of tipping paper, the perforating means being arranged to perforate the said tipping paper, and said adjusting means comprising to adjust the mean distance of the resultant perforations from the edge of the tipping paper.

4. A device for use in the manufacture of filter cigarettes comprising tobacco portions which are joined to filter portions by means of tipping paper, comprising means for perforating said tipping paper to form ventilated cigarettes including perforating pins for perforating the tipping paper mechanically, and means for controlling said perforating means to adjust the position of the resultant perforations relative to the edge of the tipping paper.

5. A device according to claim 4, for perforating double width cigarette tipping paper, including two rollers whereon said pins are mounted, and means for adjusting the relative axial positions of the two rollers in accordance with the desired position of the resultant perforations relative to the edges of the tipping paper.

6. A device according to claim 5 including means for biassing the two rollers in an axial direction towards each other, and a cam rotatable in a plane parallel to the axes of the rollers to provide a variable separation between the rollers.

7. A device according to claim 1 or claim 3 including a plurality of electrodes arranged to be supplied with a high voltage current so as to effect the said perforation by spark discharge.

8. A device according to claim 3 including means for generating a beam of radiant energy to effect the said perforation, and means for deflecting the radiant energy beam to adjust the position of the resultant perforations.

9. A device according to claim 8 wherein said radiant energy is generated by a laser.

10. A device according to claim 9 wherein said deflecting means comprises an optical reflector arranged in the path of the laser beam to adjust the position of the resultant perforations.

11. A device according to claim 8 wherein said radiant energy beam is an electron beam.

12. A device according to claim 11 wherein said deflecting means comprises an electromagnetic deflection system.

13. Apparatus for manufacturing ventilated cigarettes, including a perforator for producing a group of perforations in cigarettes, means for measuring the resultant dilution of the finished cigarettes, means for generating a signal indicative of the resultant dilution, and means responsive to said signal for controlling the perforator to alter the distance of the resultant group of perforations from the mouth end of the cigarette so as to achieve the desired level of dilution.

14. Apparatus for manufacturing ventilated cigarettes, including a perforator for cigarette paper, means for measuring the resultant dilution of finished cigarettes, means for generating a signal indicative of the resultant dilution, and means for controlling the position of said perforator in relation to said cigarette paper to alter the distance of the resultant perforations from the end of the finished cigarette so as to achieve the desired level of dilution in response to the signal from said signal generating means.

15. Apparatus according to claim 13 or claim 14 wherein said means for controlling the perforator comprises means for adjusting the relative positions of the perforator device and the article being perforated.

16. Apparatus according to claim 15 wherein said perforator comprises a plurality of electrodes and means for applying high voltage current to the electrodes so as to effect perforation by spark discharge.

17. Apparatus according to claims 13 or 14 wherein said perforator comprises means for generating a beam of radiant energy and said controlling means comprises means for deflecting the radiant energy beam to adjust the position of the resultant perforations.

18. Apparatus according to claim 17 wherein said radiant energy generating means comprises a laser.

19. Apparatus according to claim 18 wherein said radiant energy beam generator is an electron beam generator.

20. A method of manufacturing ventilated cigarettes including the steps of perforating the cigarettes by producing a group of perforations in the wrapper thereof, measuring the resulting dilution of the finished cigarettes, and controlling the perforating to alter the distance of the resultant group of perforations from the end of the subsequently perforated cigarettes so as to adjust the level of dilution to a desired level.

21. A method of manufacturing ventilated cigarettes, including the steps of perforating wrapper paper used to form ventilated cigarettes, assembling a cigarette with said perforated wrapper paper, measuring the resultant dilution of the assembled cigarette, and controlling the subsequent perforation of the wrapper paper to alter the distance of the resultant group of perforations from the end of the subsequently assembled cigarettes so as to adjust the level of dilution to a desired level.

22. Apparatus for manufacturing ventilated cigarettes, including a perforator for cigarettes, means for measuring the resultant dilution of the finished cigarettes, means for generating a signal indicative of the resultant dilution, and means responsive to said signal for controlling the perforator to alter the position of the resultant perforations relative to the mouth end of the cigarette so as to achieve the desired level of dilution, wherein said means for controlling the perforator comprises means for adjusting the relative positions of the perforator device and the article being perforated, and wherein said perforator comprises perforating pins for mechanically perforating.

23. Apparatus for manufacturing ventilated cigarettes, including a perforator for cigarette paper, means for measuring the resultant dilution of finished cigarettes, means for generating a signal indicative of the resultant dilution, and means for controlling the perforator to alter the position of the resultant perforations relative to the end of the finished cigarette so as to achieve the desired level of dilution, wherein said means for controlling the perforator comprises means for adjusting the relative positions of the perforator device and the article being perforated, and wherein said perforator comprises perforating pins for mechanically perforating.

24. A method of manufacturing ventilated cigarettes comprising the steps of perforating the cigarettes including controlling the size and/or number of perforations to control the permeability of the wrapper of the cigarette to a desired level, measuring the resultant dilution of the finished cigarettes, and controlling the perforating to alter the position of the resultant perforations relative to the end of the subsequently perforated cigarettes so as to adjust the level of dilution to a desired level without significantly altering the overall permeability of the wrapper.

25. A method as defined in claim 24 wherein said ventilated cigarettes are filter cigarettes and said perforations are provided in that part of the wrapper of said cigarettes comprising the tipping paper of the filter.

26. A method of manufacturing ventilated cigarettes, comprising the steps of perforating wrapper paper used to form the ventilated cigarettes including controlling the size and/or number of perforations to control the permeability of the wrapper of the cigarette to a desired level, assembling a cigarette with said perforated wrapper paper, measuring the resultant dilution of the assembled cigarette, and controlling the perforating to alter the position of the resultant perforations relative to the end of the subsequently perforated cigarettes so as to adjust the level of dilution to a desired level without significantly altering the overall permeability of the wrapper.

27. A method as defined in claim 26, wherein said ventilated cigarettes are filter cigarettes and said perforations are provided in that part of the wrapper of said cigarettes comprising the tipping paper of the filter.

* * * * *